US007828669B1

(12) United States Patent
Stites

(10) Patent No.: US 7,828,669 B1
(45) Date of Patent: Nov. 9, 2010

(54) VISUAL SWING INDICATOR GOLF CLUB HEAD

(75) Inventor: John T. Stites, Weatherford, TX (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 12/464,649

(22) Filed: May 12, 2009

(51) Int. Cl.
*A63B 69/36* (2006.01)

(52) U.S. Cl. ..... 473/219; 473/231; 473/238; 473/242; 473/252

(58) Field of Classification Search ..... 473/219–256; D21/736–746
See application file for complete search history.

(56) References Cited

U.S. PATENT DOCUMENTS

| | | | | | |
|---|---|---|---|---|---|
| D58,209 | S | * | 6/1921 | Bachellor | D21/745 |
| 1,485,272 | A | * | 2/1924 | Kinsman | 473/242 |
| 1,546,612 | A | * | 7/1925 | Barnes | 473/242 |
| D89,332 | S | * | 2/1933 | Bartsch | D21/733 |
| 2,842,369 | A | * | 7/1958 | East | 473/242 |
| 2,859,972 | A | * | 11/1958 | Reach | 473/242 |
| 2,908,504 | A | * | 10/1959 | Pratt | 473/237 |
| 2,934,347 | A | * | 4/1960 | Siniscalchi | 473/242 |
| 3,680,860 | A | * | 8/1972 | Elkins, Jr. | 473/409 |
| D245,437 | S | * | 8/1977 | Thiel | D21/745 |
| 4,157,830 | A | * | 6/1979 | Taylor et al. | 473/242 |
| 4,174,839 | A | | 11/1979 | Marrs | |
| 5,452,897 | A | | 9/1995 | Mick | |
| 5,839,970 | A | * | 11/1998 | Lombardo | 473/252 |
| 6,379,258 | B1 | * | 4/2002 | To | 473/242 |
| 6,988,955 | B2 | * | 1/2006 | Stoakes | 473/242 |
| 7,077,757 | B1 | | 7/2006 | Payne et al. | |
| 7,147,570 | B2 | * | 12/2006 | Toulon et al. | 473/290 |
| 7,371,184 | B2 | * | 5/2008 | Tao | 473/242 |
| 2003/0148821 | A1 | * | 8/2003 | Morgan et al. | 473/324 |
| 2004/0204257 | A1 | * | 10/2004 | Boscha et al. | 473/131 |
| 2004/0219987 | A1 | * | 11/2004 | Scott et al. | 473/200 |
| 2005/0187028 | A1 | * | 8/2005 | Chang et al. | 473/231 |
| 2005/0192114 | A1 | * | 9/2005 | Zider et al. | 473/251 |
| 2006/0166757 | A1 | * | 7/2006 | Butler et al. | 473/334 |
| 2007/0004525 | A1 | | 1/2007 | Lee et al. | |
| 2007/0072693 | A1 | * | 3/2007 | Kallberg | 473/226 |
| 2007/0217661 | A1 | * | 9/2007 | Massoud | 382/119 |
| 2007/0254745 | A1 | * | 11/2007 | Graves | 473/252 |
| 2008/0015045 | A1 | | 1/2008 | Payne et al. | |
| 2009/0017933 | A1 | * | 1/2009 | Stites et al. | 473/254 |
| 2009/0054172 | A1 | * | 2/2009 | Meehan | 473/251 |

OTHER PUBLICATIONS

International Search Report from PCT/US2010/033978, dated Aug. 19, 2010.

* cited by examiner

*Primary Examiner*—Sebastiano Passaniti
(74) *Attorney, Agent, or Firm*—Banner & Witcoff, Ltd.

(57) ABSTRACT

A golf club head with a body and an asymmetrical visual swing indicator is provided. The asymmetrical visual swing indicator may be formed to represent an apparent backswing path outward of an actual backswing path. In certain configurations the asymmetrical visual swing indicator is positioned such that a portion of the asymmetrical visual swing indicator closest to the hitting surface of the golf club is closer to a heel end plane of the golf club head then a portion of the asymmetrical visual swing indicator closest to a rear surface of the golf club head. A method of fitting a golf club head by determining an initial swing plane using a measuring device, determining a desired swing plane, and applying an asymmetrically shaped visual indicator to a golf club head based upon the determined initial swing plane and the desired swing is also provided.

22 Claims, 12 Drawing Sheets

VISUAL SWING INDICATOR GOLF CLUB HEAD

FIELD OF THE INVENTION

The present invention relates to a golf club, more particularly, to a golf club head with a visual swing indicator.

BACKGROUND

The swing of a golfer including the backswing and the downswing of a golfer is often related to the golfer's performance on the golf course. Golfers that can consistently swing a golf club in preferred manners may hit the golf ball farther, straighter and in a more consistent manner. Accuracy, control and direction may be improved when a golfer's swing has certain attributes associated with preferred swing directions and motion paths. However, many golfers have difficulty swing golf clubs according to certain preferred swing directions and motion paths. Also, because only portions of a full swing of a golf club are visible to the golfer, it may be more difficult to correct an improper backswing or downswing swing path.

SUMMARY

Inventive aspects pertain to a golf club head with an asymmetrical visual swing indicator on a top surface of the body of the golf club head and configured to represent an apparent backswing path. The apparent backswing path may be distinct and outward of an actual backswing path of the gold club head during a swing of a golfer. The golf club head includes a hitting surface on the front surface. The golf club head may also be coupled to a shaft.

Additionally, inventive aspects also relate to a triangularly shaped asymmetrical visual swing indicator oriented on a top surface of a golf club head. The triangularly shaped asymmetrical visual swing indicator may include a shortest side that is parallel with a hitting surface. On an opposing end the asymmetrical visual swing indicator may end in a pointed end at the toe end of the rear side of the top surface.

In another inventive aspect, a golf club head has an asymmetrical visual swing indicator on the top surface extending from a hitting surface housed on a front surface of the body to a rear surface of the body opposite the hitting surface. The asymmetrical visual swing indicator is positioned such that a portion of the asymmetrical visual swing indicator closest to the hitting surface is closer to a heel end of the golf club head than a portion of the asymmetrical visual swing indicator closest to a rear surface of the golf club head. The golf club head may be coupled to a shaft.

Another inventive aspect is a method of fitting a golf club head. In a method of fitting a golf club head, a determination of an initial swing path using a measuring device is made. The measuring device may include any of a variety of known measuring devices. For example, a photographic measuring device may be used in conjunction with a computing device. A determination of a desired swing path is also made. Based upon the determined initial swing path and the desired swing path, an asymmetrical shaped visual indicator is placed on a golf club head. The asymmetrical shaped visual indicator may be directly placed. Alternatively, a structure housing the visual indicator, e.g. as entire top surface or crown, may also be removed and replaced with a distinct top surface with another different asymmetrical shaped visual indicator. This visual indicator on the golf club head may assist the golfer in achieving a desired swing path.

DESCRIPTION OF THE DRAWINGS

The foregoing Summary of the Invention, as well as the following Detailed Description of the Invention, will be better understood when read in conjunction with the accompanying drawings.

DETAILED DESCRIPTION

Figure 1A:
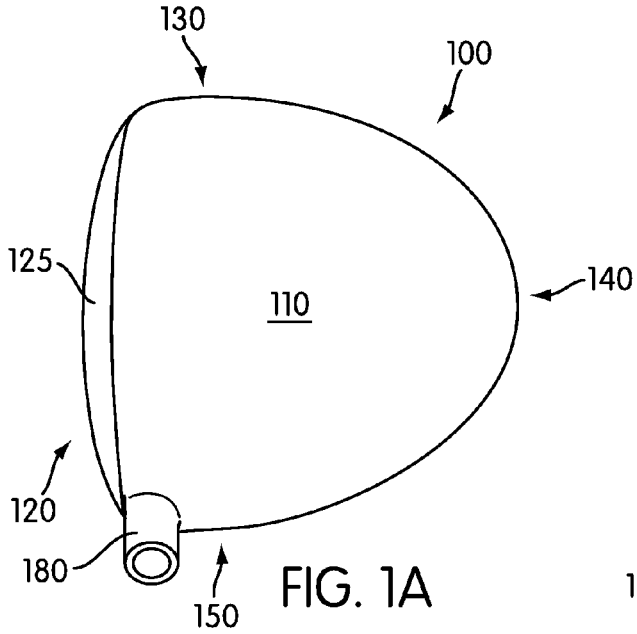
FIGS. 1A-1D are illustrative top plan, toe end, heel end and front views respectively of a golf club head.
Figure 1B:
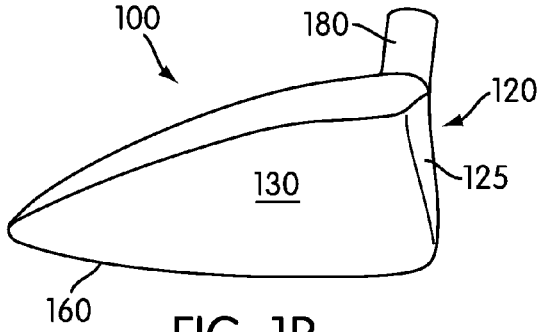
Figure 1C:
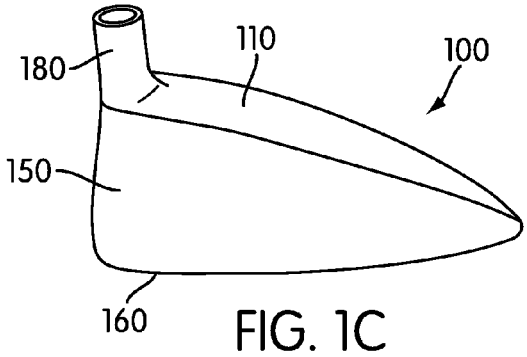
Figure 1D:
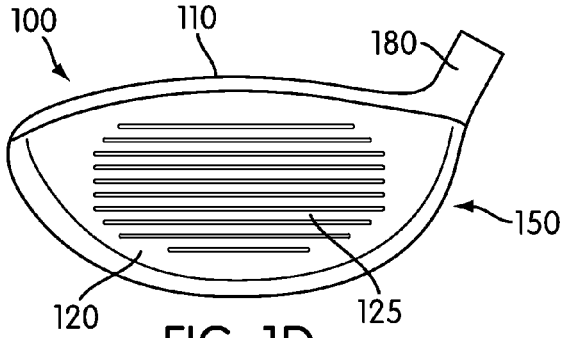

In the following description of the various embodiments, reference is made to the accompanying drawings that depict illustrative arrangements in which the invention may be practiced. It is understood that other embodiments may be utilized and modifications may be made without departing from the scope of the present invention. Additionally, various terms used herein are defined below.

FIGS. 1A-1D are schematic top, toe end, a heel end and front views, respectively, of an illustrative golf club head 100. As is apparent from the figures, a golf club head may illustratively be considered to include a top 110, a front 120, a toe end 130, a rear 140, a heel end 150 and a bottom (or sole) 160. Further, a golf club head 100 typically includes a hosel 180 formed to, among other things, facilitate connection of the golf club head 100 to the shaft 190. Hosel(s) 180 and shaft(s) 190 are well known in the art. Hosels 180 are commonly formed with the remainder of the golf club head 100 as a single body member.

Front surface 120 typically houses a hitting surface 125 configured for striking a golf ball. Hitting surface 125 may include any of a variety of features, configurations, shapes, surfaces and details. For example, hitting surface 125 may include a series of horizontal grooves that facilitate desired flight of the golf ball when the hitting surface 125 impacts a golf ball. Spacing, size, depth, shape, contour and orientation of these grooves may vary based on club type (and/or particular club manufacturer) to achieve a desired ball flight characteristic. Also, hitting surface 125 may be formed of a hardened material or may be treated to strengthen or harden the material in anticipation of the hitting surface repeatedly being used to impact the golf ball. Many other forms of surface treatments and ornamentation may be incorporated into the hitting surface 125, from hardened materials to holes, grooves, and corrugation and various other hitting surface materials, structures and configurations that are well known. The illustrative golf club head 100 illustratively shown in FIGS. 1A-1D may be commonly referred to as a "wood-type" golf club head. Wood-type golf heads may include drivers, fairway woods, hybrids clubs and other golf club heads. However, other golf club heads including "iron-type" golf club heads, putters and any other golf club heads are contemplated with regard to FIGS. 1A-1D and the corresponding illustratively features described above.

Figure 2:
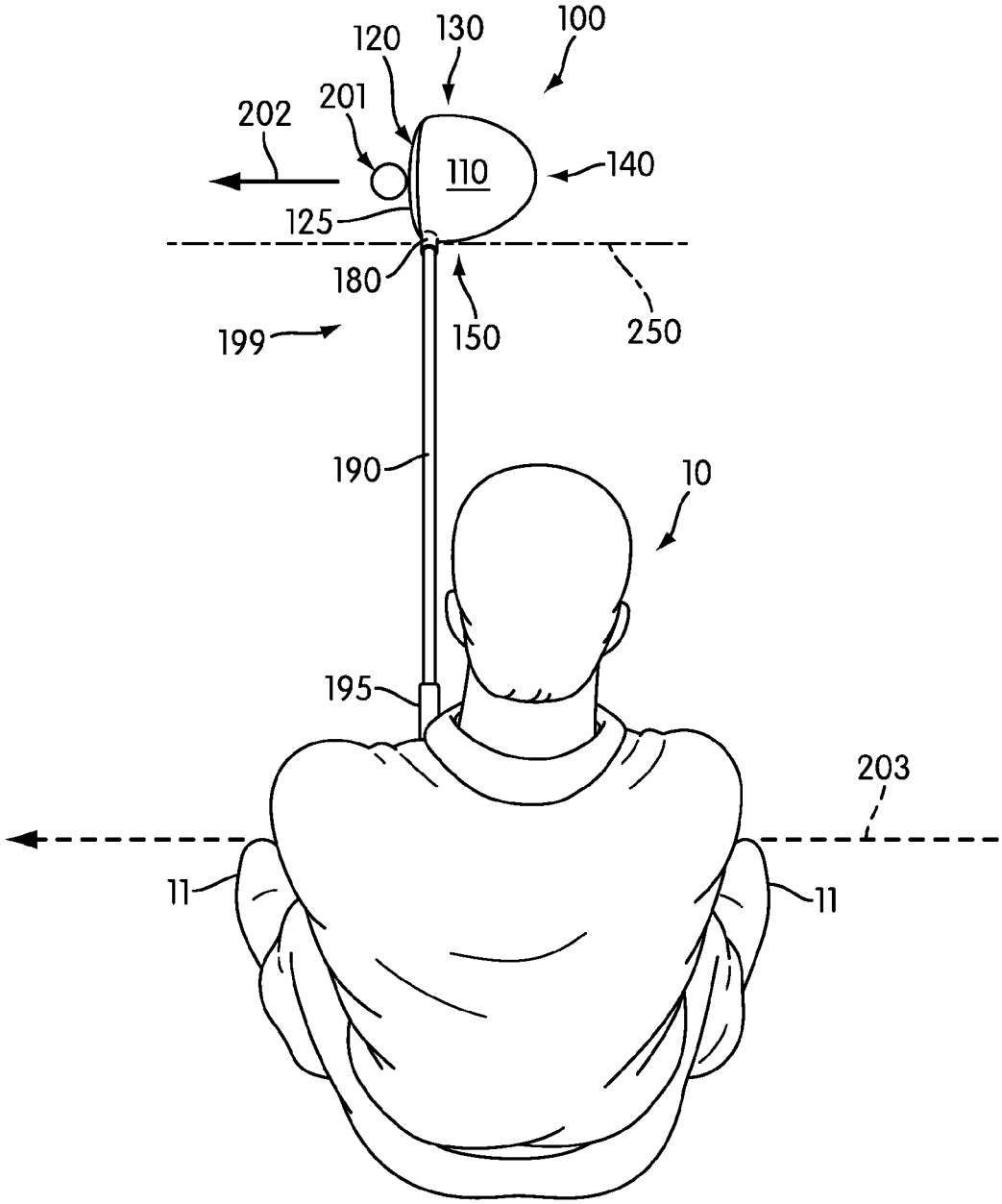
FIG. 2 is an illustrative top plan view of a golfer addressing a golf ball with a golf club including a golf club head coupled to a shaft.

FIG. 2 is an illustrative top plan view of a golfer 10 addressing a golf ball 201 with a golf club head 100. The addressing state shown in FIG. 2 is generally considered a start position for a golfer's swing for hitting a golf ball 201. The golf club 199 typically includes a shaft 190 coupled to the head 100 at the hosel 180. A grip 195, by which a golfer 10 holds or grips the golf club 199, is attached to the shaft 190 at the end opposite the head 100. Grips 195 are known and may vary significantly depending on preferences, ergonomic characteristics, and tendencies of the golfer, such as a tendency to hit a slice or a fade. For example, grips vary in "grip size" and in circumference. They also vary in particular texture and grip pattern on the outer surface of the grip. Grips can be round or may have a line or rib on the underside to assist the golfer in placement of his hands. Other shapes are also contemplated. Grips may be composed of a number of materials including rubbers, polymers, and leather, to name a few. The grip traits may be varied by, for example, by making the grip corded or selecting any of various materials based upon the frictional properties of that material.

Shaft 190, as is also known in the art, may be varied in length, material composition, stiffness, flex and other traits and features. For example, golfers may select shafts formed of a variety of materials in light of characteristics of those materials. For example, flex and stiffness are among the illustrative characteristics that may be contemplated when selecting a particular shaft or shaft material as a preferred shaft stiffness may vary from golfer to golfer depending on skill, strength and swing characteristics including swing speed or swing path. In at least one categorization system, shafts may be categorized as Extra Stiff, Stiff, Regular, Senior and Ladies depending on the particular flex characteristics. Like other golf club features, the shaft 190 and grip 195 will often be selected based upon golfer "feel" as well as traits relating to the golfers physical make-up and swing characteristics and tendencies.

As is apparent in FIG. 2, golfers generally position their feet 11 in an orientation generally aligned in the direction in which the golfer desires or is aiming to hit the golf ball 201. Although, depending on golfer preference and particular type of club being used (driver versus 5-iron versus wedge), foot positioning may be varied from this illustrative positioning as is known in the art so as to be askew by a certain rotation from the general desired travel path. For illustrative purposes in FIG. 2, arrow 202 demonstrates a "general" desired travel path of the ball 201 after the golfer 10 strikes the golf ball 201 with the front 120 (the face) of the golf club 199. The golfer's feet alignment, as demonstrated by the arrow 203, illustratively depicts the golfer's stance as being generally parallel with the general desired travel path of the ball 202. As is known, an actual travel path 202 of the ball 201 may vary from the general desired travel path as a golfer may either hit a "fade" or a "slice" of varying degrees. Likewise, the ball's flight may vary in its initial direction and general flight path curve, however, it may be desired that the ball be curved back to finish in general alignment with the general desired travel path of the ball 202. Additionally, for reference purposes, broken line 250 illustrates a heel end plane running along the heel end 150 of the golf club head and perpendicular to the ground (assuming the ground is flat). As is apparent when the golfer 10 is in a typical addressing state as shown in FIG. 2, the heel end plane 250 is parallel to the general desired travel path 202 and the golfer's feet alignment 203.

Figure 3A:
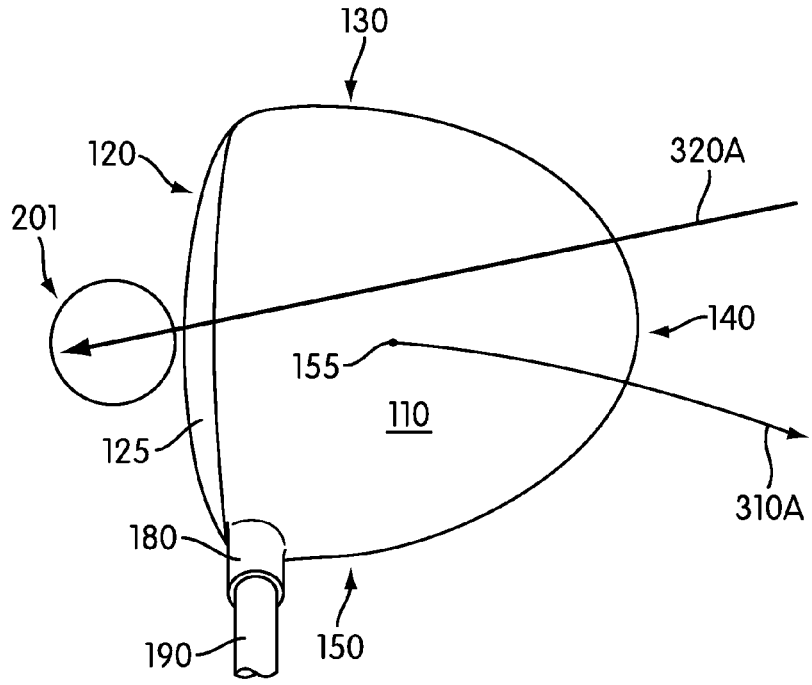
FIGS. 3A and 3B are illustrative top plan views of a golf club head and various illustrative swing paths.
Figure 3B:
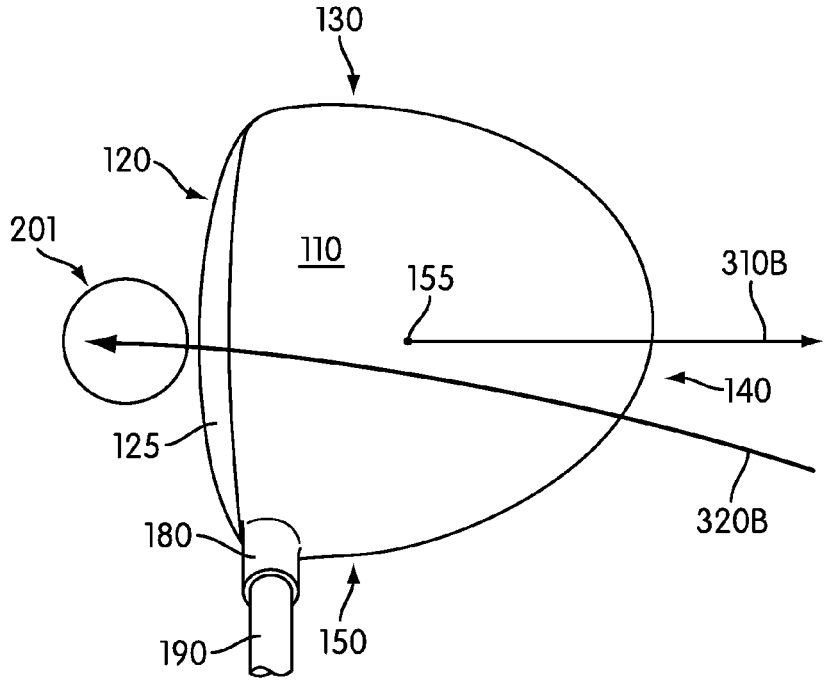

FIGS. 3A and 3B are illustrative top plan views of golf club heads and various exemplary swing paths including illustrative backswings and downswings. A golf swing may generally be considered as having an addressing state followed by backswing in which the club head 110 via the shaft 190 and hosel 180 is generally pulled rearward (and upward) of the golf ball 201 to be hit. During this backswing, the golfer also typically rotates his torso and "shifts his weight" using his legs. In essence, a golfer during the backswing is twisting or coiling his body and/or providing space in anticipation of the downswing motion that will contact the golf ball 201. The golfer 10 may continue his backswing as is known in the art until the golfer 10 reaches a "top" of the swing and then begins a downswing along a downswing path.

A center 155 of golf club head 100 is used as a reference point for further clarity and comparison in demonstrating various swing paths and directions in the figures. FIG. 3A is an illustrative diagram of a golf club head 100 depicting the swing tendencies of a high handicap player (e.g. a player that has a higher number as their "handicap" according to the well known handicapping system of rating golfers based upon their play and scores.) Generally speaking, as shown in FIG. 3A, a high handicap golf player can have a tendency to "take-away" the golf club head 100 with a more inward (heel end 150) path than recommended by golf pros and conventional swing mechanics. For example, a high handicap golfer may have a tendency to take-away the golf club head 100 from its position shown in the addressing state along the initial backswing path 310A as is depicted in FIG. 3A. In this instance, the take-away or initial backswing path 310A has a generally inward or heelward path. When a golfer 10 begins his/her backswing along backswing path 310A along this inward or heelward trajectory, he will continue that backswing path until it reaches the top of his/her backswing as is known in the art.

The specific position known as the top of the backswing can vary from golfer to golfer but it is generally know to be at a position when the shaft 190 reaches a parallel position with the ground. Of course, for varying degrees of partial swings rather than full swings this position may be significantly short of this parallel shaft position. Additional, some golfers especially including professional golfers may have a backswing that extends beyond this parallel position when they are attempting to generate significant power and trying to, for example, hit the ball at the maximum distance for a certain club.

A golfer that has an initial backswing path 310A begins the club head with a more inward or heelward path than traditionally desired will often continue his swing with an overly inward or heelward trajectory. In order to continue this inward backswing trajectory, the golfer's 10 arms are forced inward and are prevented from remaining generally extended as desired according to preferred swing mechanics. The golfer will then reach the top of his swing in a position varied from an optimal top position (for example, arms further inward and cramped and torso rotation not completed).

After reaching the top of the backswing, the golfer will now begin a downswing until the golf club head 100 contacts the golf ball 201 and then the golfer 10 will finish his swing with the "follow-through." Here, because the golfer will reach the top of the backswing in misaligned position, the golfer will have a tendency to overcompensate, as the golfer uncoils and rotates back towards the initial addressing state for contacting the golf ball 201. For example, the golfer will feel cramped and his arms will be and feel too close too his body to return to an extended position at the time of contact as he moves through the downswing. The golfer may also have trouble returning to an aligned position sufficiently quickly during the downswing so the golfer will feel hurried to "catch-up" during the swing so as to not leave the club face of the golf club open. As a result of the initial backswing path 310A being inward or heelward of a preferred path the downswing path of the golfer 10 will be affected.

As illustrated in FIG. 3A, the golfer will perform a downswing that begins outward of a preferred position. This misalignment will be carried through as the golfer will strike the ball 201 with the hitting surface 125 on the front surface 120 of the golf club head 100 with an askew outward to inward direction through the hitting area as is demonstrated in FIG. 3A. As shown, the golf club head 100 will travel with an ending downswing travel path 320A. Additionally, the front face 120 of golf club head 100 may have a rotated orientation compared to its orientation in the corresponding state of FIG. 2. Accordingly, an incorrect or contrary to convention/preference path of motion and orientation of the golf club head 100 will cause the golf ball 201 to be contacted by the hitting surface 125 of golf club head 100 contrary to a desired orientation and contact direction. Further, this varied ending downswing path 320A will cause the flight path of golf ball 201 to vary from a general desired flight path 202 and after it is contacted by the hitting surface 125 and kinetic energy from the golf club head 100 is transferred to the ball 201. The varied resulting ball 201 flight may embody a number of undesirable variations on a desired or optimal ball flight. Distance may be lost. The ball may have a flight path of a slice or fade when a generally straight ball flight is desired. Even if the flight path of the golf ball 201 after being hit by a swing as described in FIG. 3A is generally straight it may be askew directionally due to the path of club head movement 310A at time of contact being diagonal relative to a desired flight path 202. Additionally, a club head front 120 including hitting surface 125 may be rotated relative to a desired "square" or other orientations leading to additional spin or direction variances to be introduced into the resulting ball flight.

FIG. 3B is an illustrative diagram of a golf club head 100 depicting the swing of a preferred backswing and downswing path of a golfer to achieve preferred results. While each golfer may have a somewhat unique and particular swing, golfers of low handicap including professional golfers typically have swing tendencies that are similar or correlate to the described and depicted in FIG. 3B. As is depicted, contrary to the swing tendencies of a high handicap golfer, low handicap golfers have an initial backswing path 310B that is generally straight rearward from the addressing state. By having an initial take-back that is generally straight, the golfer typically continues his/her backswing along a preferred backswing path until reaching a "top" of the backswing. The low handicap golfer draws the golf club head 100 generally rearward and upward and typically rotates his torso and "shifts his weight" using his legs during a backswing. As described, the low handicap golfer is twisting or coiling his body and/or providing space in anticipation of the downswing motion that will contact the golf ball. However, contrary to that shown in FIG. 3A, the backswing including initial backswing path 310B are proper as the initial take-away of golf club head 100 is straight forward. Accordingly, there is an increased likelihood and tendency for the golfer 10 with an initial backswing path 310B to reach the top of his swing in a proper position and orientation, such that when the golfer then proceeds with the downswing he will be likely to return to the square or slight inward to outward preferred swing path, specifically, ending downswing path 320B.

It is apparent that the preferred ending downswing path 320B is distinct from the initial backswing path 310B and not merely the same path in the reverse direction. This variation is well known in the art as based upon dynamics and mechanics of the golf swing as the golfer is connected to the golf club head 100 through the shaft 190 and grip 195. Accordingly, in a preferred mechanics golf swing, the golf club is generally pivoted around the hands of the golfer as the golfer swings. However, as mentioned and is known in the art, the golfer's lower body including his legs and torso also move, translate, and/or rotate to allow the golfer to generate a smooth and powerful swing. Because the golf club head 100 is coupled to the golfer 10 and his hands gripping the grip 195 through shaft 190 and grip 195 during the swing, the golf club head 100 will be moved from a somewhat inward position during the downswing and become aligned with the golf ball 201 in the general desired travel path 202 (which is often parallel with the alignment of the golfer's feet) when the hitting surface 125 of the golf club head 100 impacts golf ball 201 or only a little bit before hand. As a result of the hitting surface 125 of the golf club head 100 impacting the golf ball 201 in a square position the golf ball will likely have a ball flight or travel path similar in direction to the desired travel path 202.

From the depiction and accompanying descriptions of FIGS. 3A and 3B it is apparent how the initial backswing path 310A-B will likely affect the downswing and performance of the golfer 10 and the associated particular swing as a whole including the striking of the ball 201. As shown in FIG. 3A, a golfer 10 that takes the golf club head 100 back inside, e.g. initial backswing path 310A, will typically cast over and return the club head in an "outside-inside" manner as illustrated in FIG. 3A. As a result, the golfer hits the ball on the toe end 130 of the hitting surface 125 ("toeing") and/or slices the ball. In contrast, as illustrated in FIG. 3B, a golfer 10 that takes the golf club head 100 straight rearward or square during the take-away such that the initial backswing path 310B is straight, has a greater likelihood of returning the golf club head 100 in an inside out downswing path including resulting in generally square contact between the golf ball 201 and the hitting surface 125 at the "sweet spot." While a golfer 10 may recognize that a straight take-away of the club is desirable, high handicap golfers, golfers that play infrequently and other golfers may develop habits, tendencies or improper muscle-memory movements such that further assistance is needed to help prevent such golfers from continually repeating these common mistakes especially relating to the backswing or initial take-away of golfers.

For example, golfers often refer to a "feel" when contact is made between the club and the ball and also during just the backswing and downswing among other times during a round of golf. As such, certain golfers through repetition of improper swing mechanics may have trained their body such that when the golfer 10 moves the golf club head 100 in a preferred initial backswing path 310B, this take-away feels wrong and the golfer does not feel as if they are taking the golf club head 100 rearward 140 in the desired manner. Likewise, when the golfer 10 moves the golf club 199 such that the golf club head 100 has an initial backswing path 310A the golfer 10 may feel as if their backswing was proper and straight when in fact their backswing was incorrect and not straight rearward. Therefore, a mechanism for making a golfer 10 with tendencies to perform a backswing along initial backswing path 310A perform an initial backswing path 310B in accordance with preferred mechanics of golf is beneficial.

Figure 4:
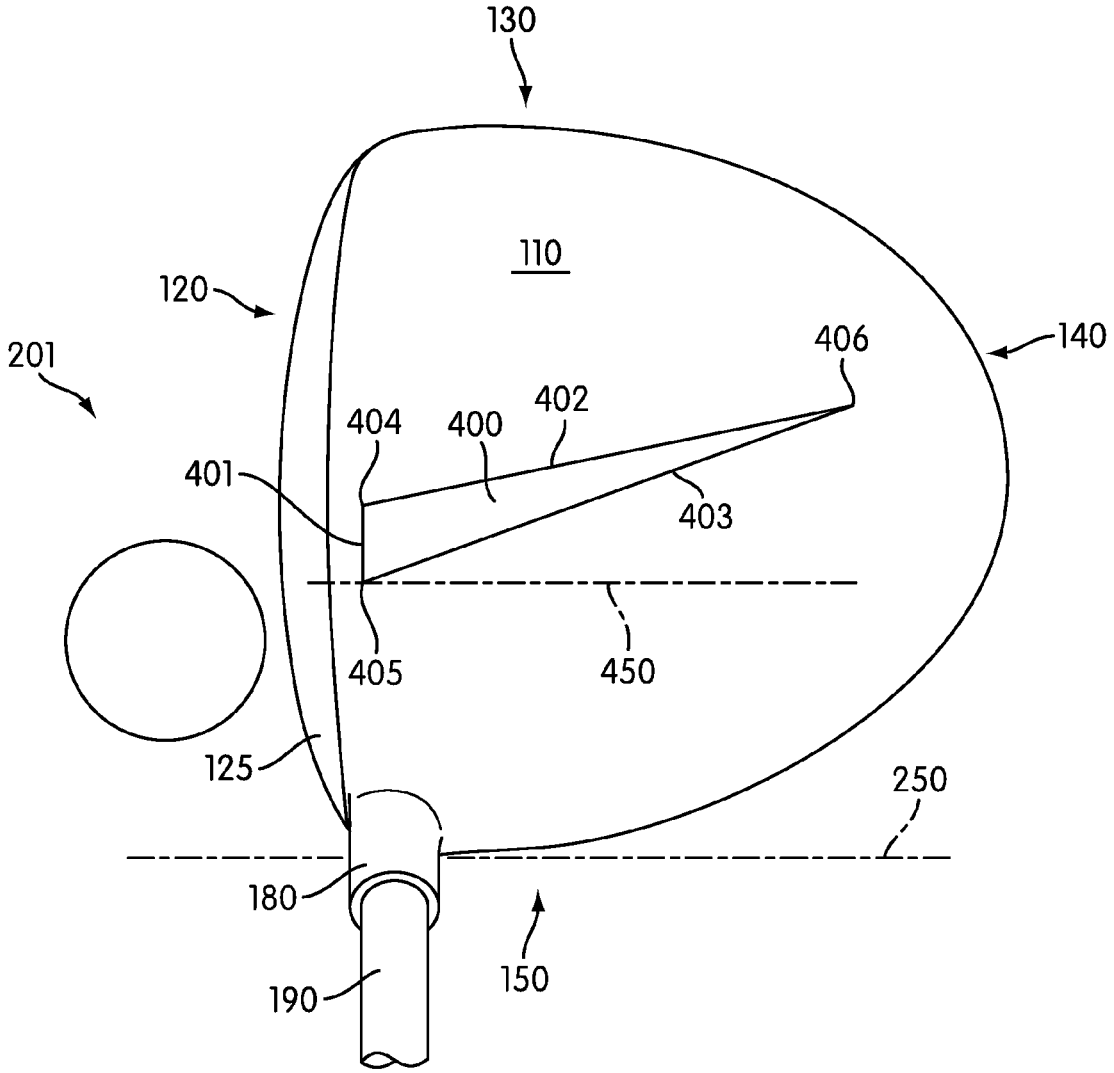
FIG. 4 is an enlarged illustrative top plan view of a golf club with a visual swing indicator.

FIG. 4 depicts an illustrative diagram of a visual swing indicator 400 housed on the top surface 110 configured to assist the golfer taking the golf club head 100 back "straight" or "square." To facilitate a proper initial backswing path 310B despite a golfer's improper tendencies a visual swing indicator 400 may be housed on a top surface 110 of a golf club head 100 to help the golfer 10 take the golf club head 100 back more square. A visual swing indicator 400 may have a variety of particular configurations including varied size, shapes, dimensions, orientations and appearances, etc. Depending on particular tendencies of a golfer, the visual swing indicator 400 may have a particular configuration. For example, to assist a golfer 10 with an initial backswing path 310A due to a tendency to bring the golf club head 100 inward during the backswing rather than straight back, the visual swing indicator 400 is orientated such that the front side of the visual swing indicator 400 is parallel to the front surface 120 of the golf club head 100 and the visual swing indicator 400 runs rearward and towards the toe end 130. In such a configuration the visual swing indicator 400 may be described as pointing from a front of a golf club head 100 toward an area between the rear 140 and the toe end 130 of the golf club head 100. A golfer 10 in an addressing state looking downward at the top surface 110 of the golf club head 100 will view the visual swing indicator 400 as a reminder and a pointer as to the direction that the golfer should begin the take-away of the golf club head 100 from the addressing state. Thus, when the golfer 10 begins the take-away of the golf club head 100 he will "feel" as if he is bring the golf club head outward of a straight initial backswing path 310B. However, in fact, he will be performing an initial backswing path 310B that has a straight rearward path. Accordingly, by following the visual swing indicator 400 indicated path which acted as reminder and guide as to which direction to take-away the golf club head 100 from the initial addressing state, a golfer can more easily overcome a tendency to have an improper take-away such as the initial backswing path 310A of FIG. 3A. Because golfer 10 now was able to modify his backswing to have an initial backswing path 310B that is generally straight rearward, there is an increased likelihood the golfer 10 will be able to return the golf club head 100 in a proper path through the hitting region and contact the golf ball 201 in a proper and preferred fashion including an ending downswing path 320B rather than ending downswing path 320B, as was previously described.

In the depicted illustrative configuration shown in FIG. 4, the asymmetrical swing indicator 400 is triangularly shaped with first, second and third sides 401, 402, 403 and first, second and third corners 404, 405, and 406. For reference purposes, any one of the sides 401-403 and/or one of the corners 404-406 may be considered an "end" of the visual swing indicator 400. Additionally, as is apparent from FIG. 4, the visual swing indicator 400 in this configuration is oriented such that the overall shape of visual swing indicator 400 points in the rear 140 and toe end 130 direction from the perspective of a golfer 10 in an addressing state. First side 401 of the visual swing indicator 400 is the shortest side in length. Second side 402 is second in length and third side 403 is the longest side. As such, each of the three sides 401, 402, 403 has a different length.

The visual swing indicator 400 in certain configurations may be positioned such that the first side 401 sits closer to the heel end 150 of the golf club head and is parallel to the hitting surface 125 on the front surface 120 of the golf club head 100. As described, the other two sides 402, 403 of the visual swing indicator 400 will then run such that the asymmetrically shaped visual swing indicator 400 has an orientation running from the front 120 and the heel end 150 of the top surface 110 to the toe 130 and rear end 140. Accordingly, side 402 of the visual swing indicator 400 may be aligned with a portion of the ball 201 closest to the toe end 130 when the golfer 10 is in the addressing state. In this alignment, the golf ball will sit on the heel end 150 side of a center of the golf club head 100. While golfers traditionally try and align a golf ball to be in the center of the golf club head 100 and in particular in the center region of the hitting surface 125 (which is commonly referred to as the sweet spot), this configuration of the visual swing indicator 400 will encourage a golf ball 201 to be aligned closer to a heel end 150, than a toe end 130. Positioning the golf ball 201 in this fashion in the addressing state also facilitates and assists the golfer 10 in an improved swing and performance as most golfers (including high handicap golfers) have a tendency to strike the golf ball 201 with the hitting surface 125 during the downswing portion of the swing at a location approximately a half inch or even more closer to the toe end 130 of the hitting surface 125 than where they lined up when they were in the addressing state. Therefore, positioning the golf ball 201 a given distance closer to the heel end 150 of the hitting surface 125 in the addressing position may facilitate the golfer striking the golf ball with the center or "sweet spot" of the hitting surface of the golf club head by accounting for the described tendency to strike the ball further on the toe end 130 of the club head 100 than the alignment location in the initial addressing state. By aligning the toe end side 402 of the visual swing indicator 400 with a toe end side of the golf ball 201, a smooth visual impression can be formed that facilitates proper swing mechanics despite tendencies of the golfer 10. Additionally, initial alignment of the golf ball may be more easily and more consistently accomplished because the visual swing indicator 400 may also be used as a reference for aligning and positioning the golf club head 100 in the addressing state. While the golf ball 201 may be aligned with the visual swing indicator 400 in the fashion described during the addressing position, the visual swing indicator 400 may also be formed such that first side 401 is centered between the toe end 130 and heel end 150 and aligned with the center of the hitting surface 125. Certain golfers may strike the golf ball 201 at the same position on the hitting surface 125 and thus a centered alignment in the addressing state may better facilitate proper alignment and striking of the golf ball during the golfer's downswing. Likewise, the visual swing indicator 400 in certain configurations may even be positioned such that a front side 401 sits closer to the toe end 130 than the heel end 150. Accordingly, it is understood by those with skill in the art that the particulars of the visual swing indicator 400 especially including positioning on the top surface 110 of the golf club head 100 may be varied depending on the swing tendencies, physical characteristics and preferences of an individual golfer 10.

Figure 5A:
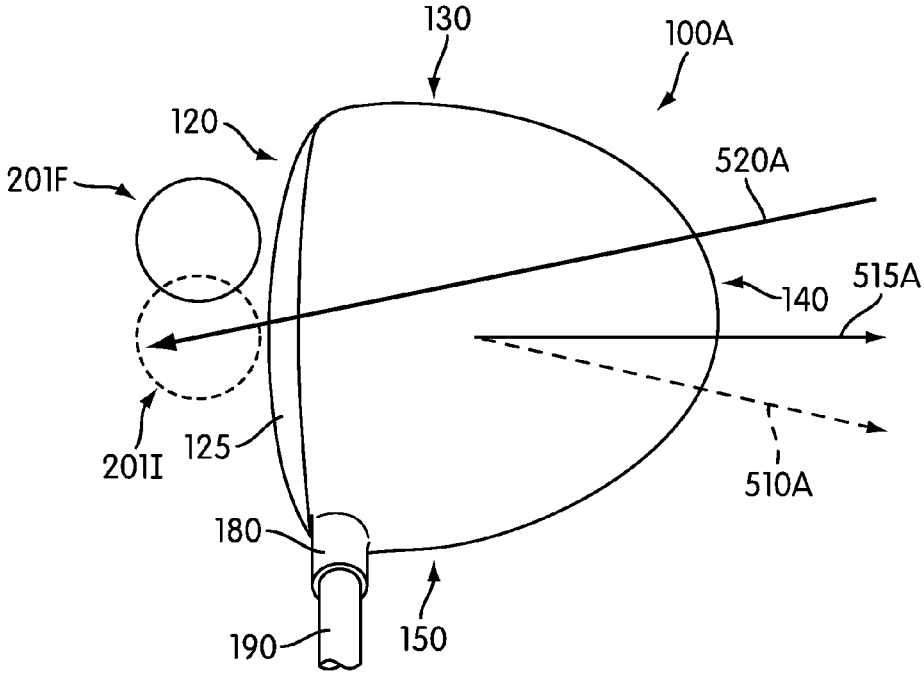
FIGS. 5A-5B are illustrative top plan views of various golf club heads depicting swing paths and tendencies.
Figure 5B:
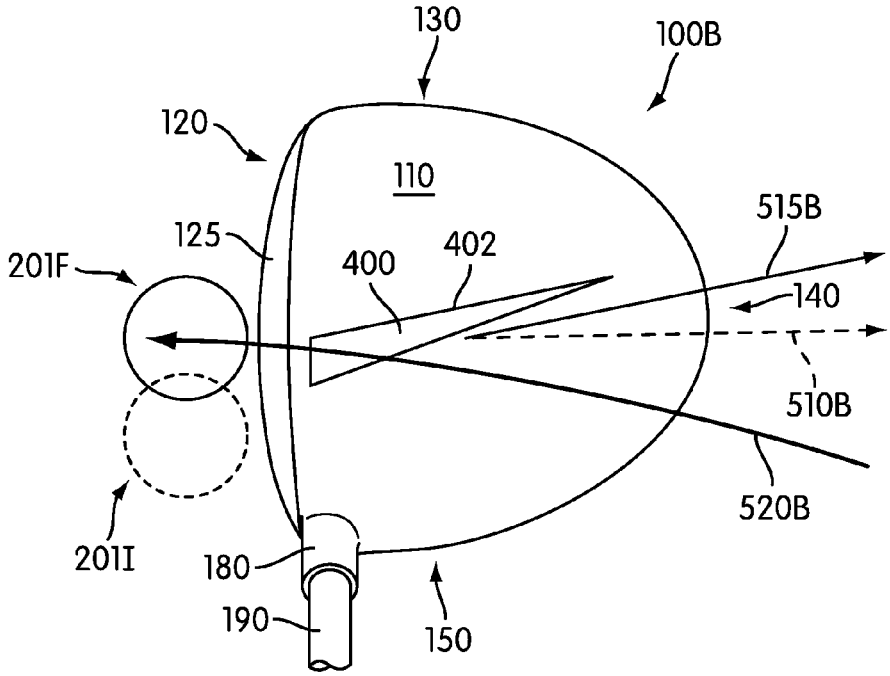

FIGS. 5A-B, in accordance with that described with respect to FIGS. 3A-4, illustratively depict one configuration of a golf club head 100 with a visual swing indicator 400 housed on the top surface assisting a golfer in performing a golf swing according to traditional preferred golf swing mechanics. FIG. 5A illustrates the feel of a backswing and a downswing of a golfer using a traditional golf club head. In an addressing state, the golfer will align the golf club head 100 with the golf ball 2011 (shown in broken lines) in an addressing state as shown. Here the golf ball 2011 may typically be on the ground or on a tee and centered between the toe end 130 and the heel end 150 as shown. The golfer 10 then begins his backswing. FIG. 5A illustrates that the golfer with tendencies to bring the golf club head 100 inward will believe he is taking the golf club head 100 back along a backswing path 515A when the golfer is in fact taking the golf club head 100 back along actual backswing path 510A. As described, this initial inward take-away of the golf club head 100 will make it more likely that the golfer will not return the club head 100 in a square manner along a traditionally preferred golf downswing and instead will come from an outward in direction as illustrated by downswing path 520A. Additionally (and often relatedly), the golfer will also contact the golf ball in a position closer to the toe end than where the golf ball 201 was positioned relative to the golf club head 100 in the addressing state.

In contrast, various golfers, especially including golfers with high handicaps, can overcome swing tendencies and perform a swing more consistent with the recognized preferred swing mechanics and paths of golf professionals. As illustrated in FIG. 5B, the golf club head 100 houses an asymmetrical visual swing indicator 400. In the addressing state, the golf club head 100 may be positioned such that the second side 402 of the visual swing indicator 400 is aligned with a toe end of the golf ball 2011. A golfer in the addressing state will look down at the top 110 of club head 100 and using the visual swing indicator 400 he will bring back the golf club head along an actual backswing path 510B which is straight back despite an apparent backswing path 515B based upon the visual impression that the visual indicator 400 provides during the initial take-away. Now, the golfer 10 will continue his backswing, reach the top, and then will perform his downswing. As discussed, the golfer, having taken the golf club head back square along actual backswing path 510B is significantly more likely to return the golf club head 100 through a hitting region and through an ending downswing path 520B such that a proper swing path is performed so the ball 201 is contacted in the sweet spot at the central region of the hitting surface and with the golf club head 100 including hitting surface 125 in a proper square orientation. As described, the golfer 10 is able to rely on the visual swing indicator 400 to guide him in his initial backswing or take-away despite the fact the swing may not "feel" like the club is being taken back square. Thus, because the apparent backswing path 515B (formed by visual swing indicator 400) is outward of the actual backswing path 510B, a golfer with a tendency to have an initial backswing inward of a square take-away may rely on the visual swing indicator 400 to perform the backswing in a preferred manner. Thus a resulting preferred downswing and contact with the golf ball 201 is accomplished. The resulting shot is thus likely to exhibit improved distance, control, direction and other characteristics as a result of the improved swing mechanics and paths of the golfer's swing.

It is understood and contemplated that each golfer varies in physical characteristics and swing tendencies. While certain visual swing indicators 400 and golf clubs utilizing visual swing indicators 400 may be appropriate for a range of golfers, a variety of visual swing indicator 400 configurations are contemplated consistent with the principles described herein. Similarly, while configurations involving wood-type golf clubs have been used, a variety of configurations involving a variety of club types have been contemplated.

Figure 6A:
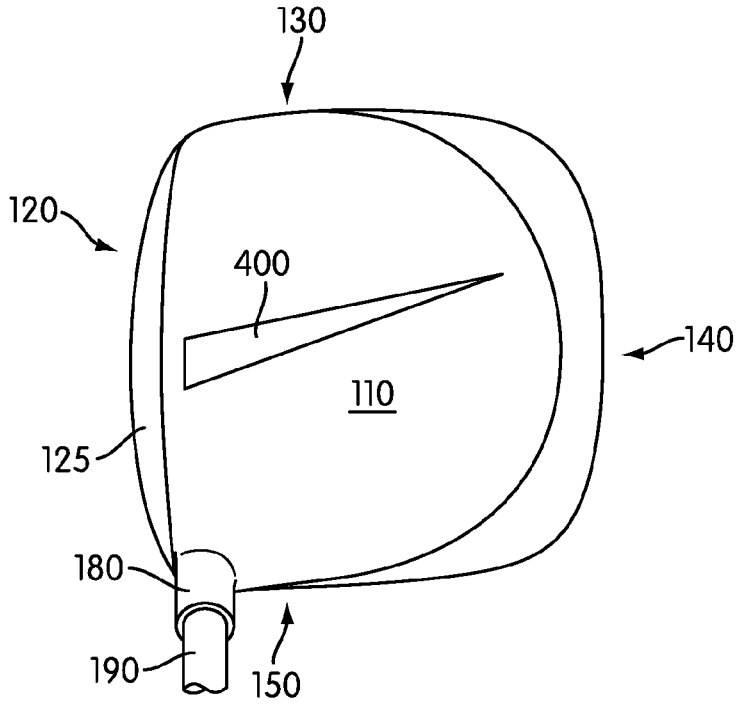
FIGS. 6A-6C are illustrative top plan views of golf club heads with visual swing indicators.
Figure 6B:
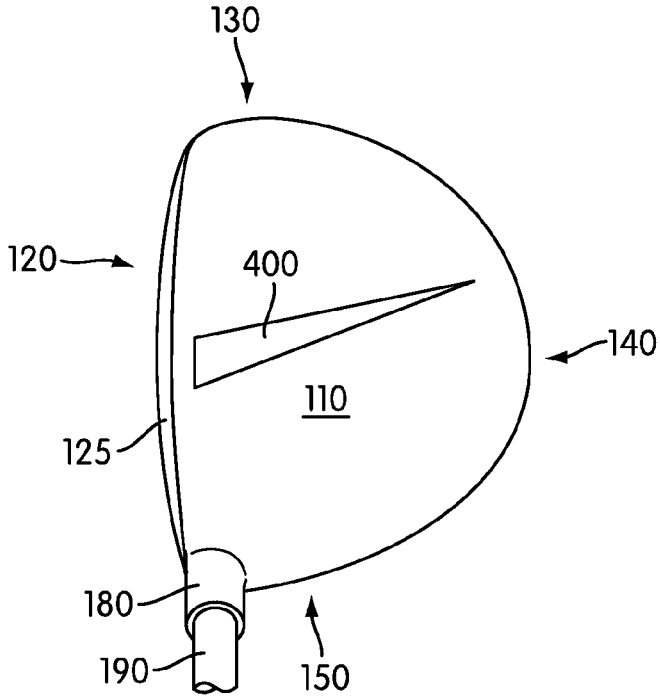
Figure 6C:
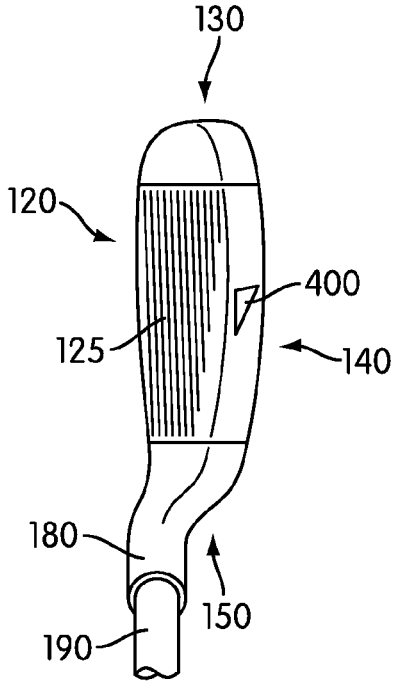

FIGS. 6A-6C illustratively depict several configurations of golf club heads 100 housing visual swing indicators 400 consistent with the principles described. While the previous figures have illustratively shown a rounded wood type golf club head, configurations utilizing the visual swing indicator 400 with square club heads including square and oversized drivers are contemplated. Additionally, configurations of hybrid golf club heads with a visual swing indicator 400 are also contemplated. Further, while iron-type golf club head, such as the golf club head 100 shown in FIG. 6C, conventionally have a smaller top surface 110 than a wood-type golf club head, especially in a front 120 to rear 140 direction, configurations of irons utilizing the described principles are also contemplated. As shown in FIGS. 6A-6C, the specific dimensioning and shape of the visual swing indicator 400 may be varied for an associated club head 100 or for the tendencies of the golfer such that the desired visual swing assistance functions are accomplished. For example, a smaller visual swing indicator 400 is housed on a top surface 110 of the golf club head 100 in FIG. 6C. Here, the asymmetrical visual swing indicator 400 is also triangularly shaped but the dimensions and appearance of the triangularly shaped visual swing indicator 400 are distinct from those shown in FIGS. 6A and 6B. Variations in the particular shape and orientation may be made to correlate to an individual golfer's swing tendencies but also to variations in typical swing tendencies that may vary by club type as a typical swing of a golfer using an iron-type golf club is typically distinct from the same golfer's swing with a wood-type golf club. Thus, a visual swing indicator 400 used in conjunction with a wood-type golf club may have a more outward orientation than a visual swing indicator 400 on an iron type golf club since the golfer's inward initial backswing tendency may be greater than with the wood-type golf club than with the iron-type golf club and thus a more exaggerated visual swing indicator 400 orientation is appropriate.

Figure 7A:
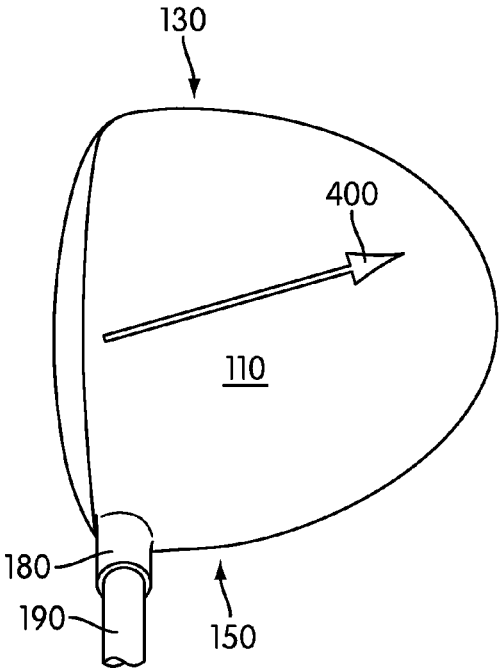
FIGS. 7A-7D are illustrative top plan views of golf club heads with visual swing indicators.
Figure 7B:
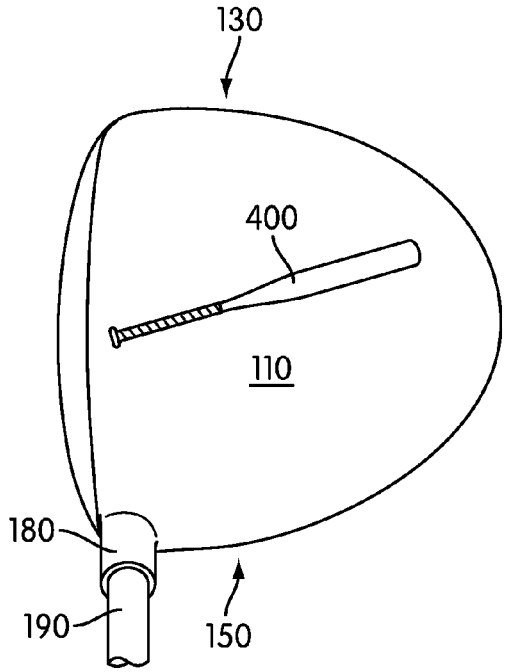
Figure 7C:
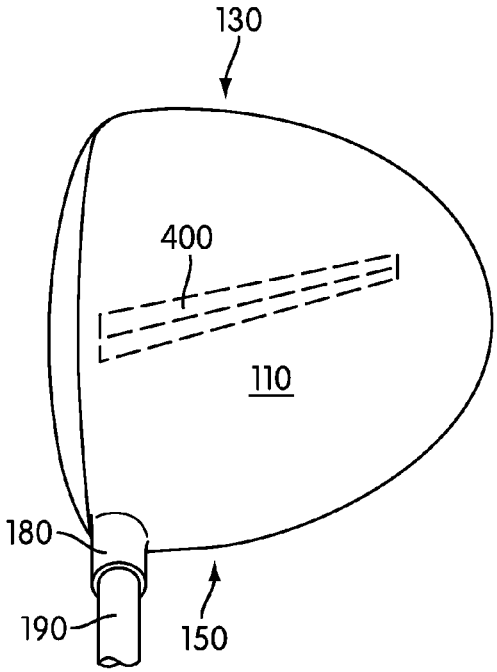
Figure 7D:
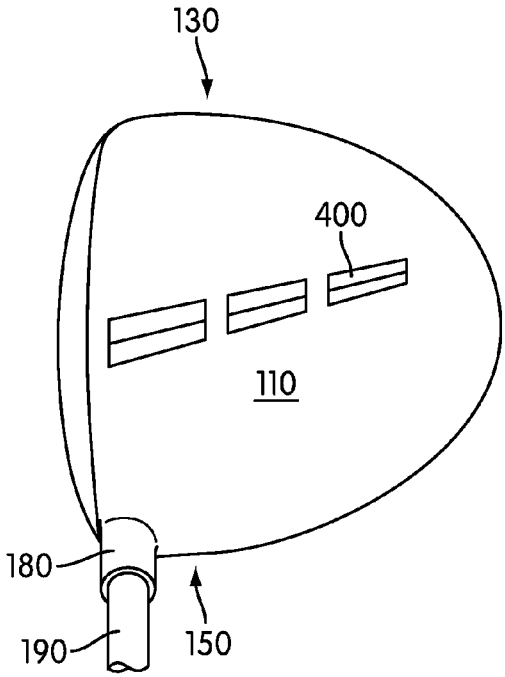

Additionally, even in a given orientation and size, the visual swing indicator 400 may be formed to possess preferred visual characteristics, shapes, and attributes that optimize golfer comfort, feel, and performance. Since golfers, like many other athletes, enjoy their craft, the particular appearance of the visual swing indicator 400 may contain some expression while serving as a device for assisting the golfer's swing. As demonstrated in FIGS. 7A-7D, numerous configurations of a visual swing indicator 400 are contemplated consistent with the aspects described. In FIGS. 7A and 7B, visual swing indicator 400 has been formed, shaped and sized to resemble an arrow and a baseball bat respectively. In FIGS. 7C-7D the visual swing indicator 400 has been formed shaped and sized to resemble a strip or a plurality of strips with an interior line in the same direction and thus may serve to further enhance the visual effect and further help the golfer visually perceive the visual swing indicator 400 when the golf club head 100 is both static and moving.

Figure 8A:
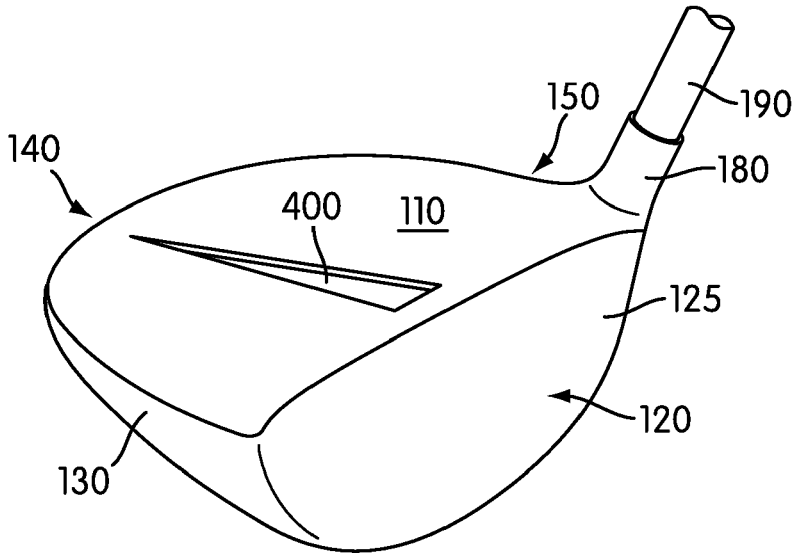
FIGS. 8A-8B are illustrative perspective view diagrams of golf club heads with visual swing indicators.

Also, many manners of incorporating the visual swing indicator 400 into the golf club head 100 are contemplated. In one configuration a golf club head may be formed during the manufacturing process to include the visual swing indicator 400 as a portion of the top surface of the golf club head 100. In such a configuration, the visual swing indicator 400 may be formed as part of a golf club head 100 as a unibody member. Accordingly, a molding or casting or related manufacturing processes that may be used to form the golf club head may account for the visual swing indicator 400 such that a mold is formed to include the visual swing indicator 400 feature as desired. Also, the visual swing indicator 400 may be a protruding structure or extending upward off the top surface such that a generally smooth top surface 110 is interrupted by a visual swing indicator 400 extending upward beyond the general plane of the top surface 110. Alternatively, the visual swing indicator 400 may be formed such that the entire visual swing indicator 400 is formed as a recess in the top surface 110 of the golf club head 100 as is illustratively depicted in FIG. 8A. A recessed visual swing indicator 400 may exhibit some preferred characteristics as the visible impression created by the visual swing indicator 400 may be more apparent visually to the golfer 10 during the addressing state as well as during the initial movement of the golf club head 100 during an initial take-away because the three dimensional aspects may provide further enhance visibility qualities. Further visual enhancements may be used such as contrasting or coloring of the visual swing indicator 400 or contrasting or coloring the sides of the recessed visual swing indicator 400 to further make the visual swing indicator 400 apparent to golfer 10 during a swing of the golf club 199.

Figure 8B:
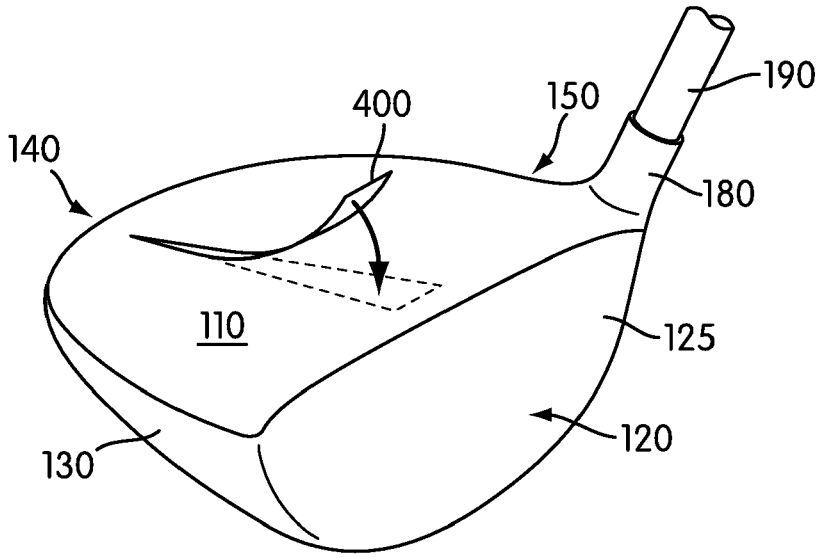

In further configurations, the visual swing indicator 400 may be applied to a top surface 110 of the golf club head 100 after the golf club head 100 has been cast, molded or otherwise formed as is known in the art. Generally speaking, a visual swing indicator 400 may be attached to a top surface 110 of the golf club head 100 as a coating (including paint), a film, an adhesive, an appliqué or various other forms of application. After the golf club is formed of a material, often a metal, the surfaces of the golf club head 100 are treated and coated to improve the durability of the metal and golf club 199 and/or make the golf club head 100 more appealing. Accordingly, a visual swing indicator 400 may also be applied in a similar manner during these painting, coating and related treatment processes during manufacturing of the golf club head 100. A visual swing indicator 400 may also be applied to existing golf club heads 100 in a similar fashion as a further coating, film, paint or the like. Newly manufactured clubs and previously manufactured or after market clubs may be fitted for a visual swing indicator 400 and can be painted on, applied as an adhesive tape, or through an appliqué as desired. FIG. 8 illustratively demonstrates a visual swing indicator 400 in the configuration of an adhesive tape or appliqué being placed on a top surface 110 of a golf club head 100.

Golf professionals are known to work with golfers to assist them in improving their golf game including their swing and associated play by analyzing the golfer's tendencies, providing instruction and recommendation regarding modifications to their swing and also in recommending various equipment including selection of clubs. Further, a golf professional for a certain golf manufacturer may offer a selection of features for which the golfer may select either alone, or with the assistance of the golf professional. Among the features that vary from golf club head to golf club head may be particular visual swing indicator 400 housed on the top surface 110. Each golfer may have a swing tendency that is varied from other golfers. Therefore, a series of visual swing indicators 400 may be available for attachment and use depending on the particular golfer's tendencies needs and desires.

The particulars of the golf club head 100 may be varied in any of a number of varied configurations utilizing an attachment means for attaching the visual swing indicator 400 to the remainder of the golf club head. The visual swing indicator 400 may be snapped onto a top surface, slid and locked into place or applied as an appliqué, paint or the like. For example, the visual swing indicator 400 and the top surface may have complimentary male and female components to form a connection as is know in the art. Snaps, slider mechanism, track and followers and numerous other mechanisms are known. The visual swing indicator 400 may be housed on a member configured with a complimentary structure for attachment to a structure housed on a top surface 110 of the golf club head 100. In other configurations, the attachment mechanism may include a top surface 110 may be removed and replaced with a different top surface including either a top surface 110 with a visual swing indicator 400 or another "distinct" visual swing indicator 400 depending upon whether the golf club head 100 originally included a top surface 110 without a visual swing indicator 400 or with a visual swing indicator 400. Varied top surfaces 110 may be snapped into place or be attached using an adhesive such as glue or other known securing substances. As such, various mechanisms consistent with the principles described above and further herein are contemplated for use with varied configurations of top surfaces and visual swing indicator 400 and associated alternate means.

Figure 9:
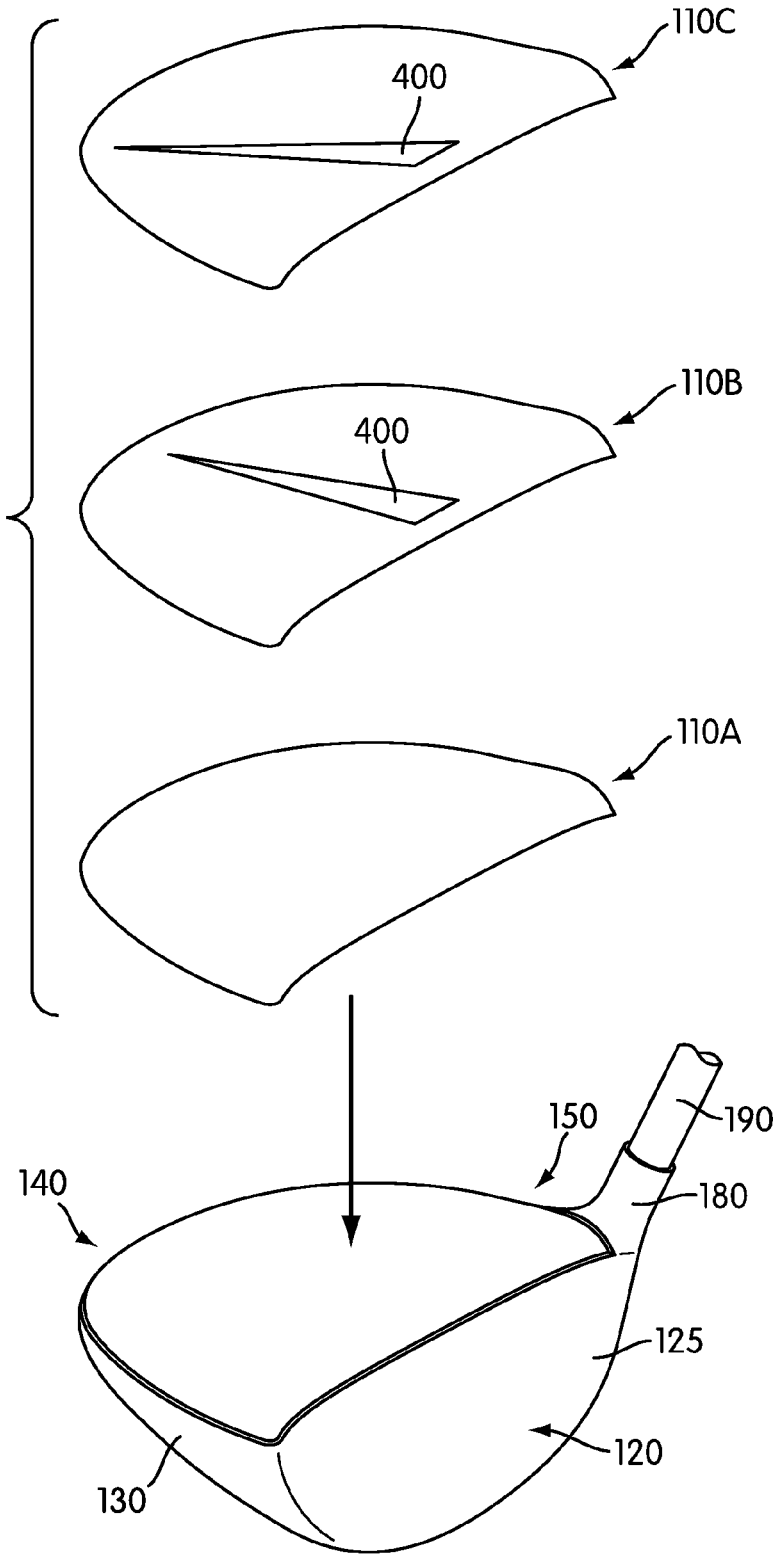
FIG. 9 is an illustrative exploded perspective view diagram of golf club head variable with a number of different visual swing indicators.

FIG. 9 is an exploded view illustrative depicting a schematic diagram of a golf club head 100 with are removable top surface 110. A top surface of a golf club head 100, especially including a wood-type golf club head, may also be referred to as a "crown" of the golf club head 100. Here, FIG. 9 illustrates three top surfaces 110A, 110B, and 110C that may used with the golf club head 100 in an interchangeable fashion. Top surface 110A is a conventional top surface without a visual swing indicator 400. The golf club head may come with a top surface 110A as a standard top surface. Top surfaces 110B and 110C are top surfaces including visual swing indicators 400. The visual swing indicators 400B and 400C may vary by shape, size, and/or orientation. Accordingly, a particular golfer may choose between a variety of top surfaces 110B, 110C of a golf club head and select one of the top surfaces 110B, 110C. In one configuration, a golf fitting professional may provide a cart or display housing various top surfaces that either a golfer may select or the golf fitting professional may recommend based upon the tendencies of the golfer as measured during analysis of the golfer's swing.

Additionally, in a fitting process, a golfer may have his swing analyzed by a professional either visually or by using any of various measuring and analysis devices as are known in the art and will be described further below. Based upon these measurements and analysis of the golfer's swing and swing path as a compared to an actual desired swing path, a given top surface 110B or 110C may be chosen for facilitating an improved golf swing as described previously. Accordingly, a series of top surface 110A, 110B, 110C can be made available such that a variety of golfers having different characteristics, preferences and specific swing paths may use different tops surfaces with visual swing indicators 400 from the series. While FIG. 9 illustrates a series of top surfaces 110 including three distinct club top surface, it is contemplated that a series could include a larger number (e.g. 6, 10, 18 etc) of top surfaces housing varied visual swing indicators 400 so as to provide the desired level of personalization for fitting a golfer with a golf club head 100 with a visual swing indicator 400 for assisting the golfer in overcoming a given tendency.

While a golfer may be fit with a golf club head with one of a series of top surface 110A-110C at a golf shop, securing of the chosen top surface 110A-110C may need to be performed at a manufacturing location in order for a top surface 110 to be integrally formed (e.g. cast). Alternatively, in order for a sophisticated adhesive process and/or material be applied to sufficiently hold the top surface 110 selected on the remainder of the golf club head 100 as the golf club head 100 is used during various swinging and related movements, where the manufacturing of the golf club head 100 may be performed. Additionally, a golfer may use a demonstration or exemplary golf club to select a preferred golf club head from a series and then the golfer may select which version of a golf club head 100 the golfer desires. The top surface may each be one in a series of top surfaces having visual swing indicators 400 that vary in orientation by incremental variances for selection by the golfer (perhaps with assistance). Once a particular top surface 110 (and associated visual swing indicator 400) is chosen, an order may be placed for this particular model of golf club head and a golf manufacturer or other company at the manufacturers direction will produce a copy of that golf club 199 including a golf club head 100 having a visual swing indicator 400 in the orientation and particulars as selected by the golfer/customer.

Figure 10A:
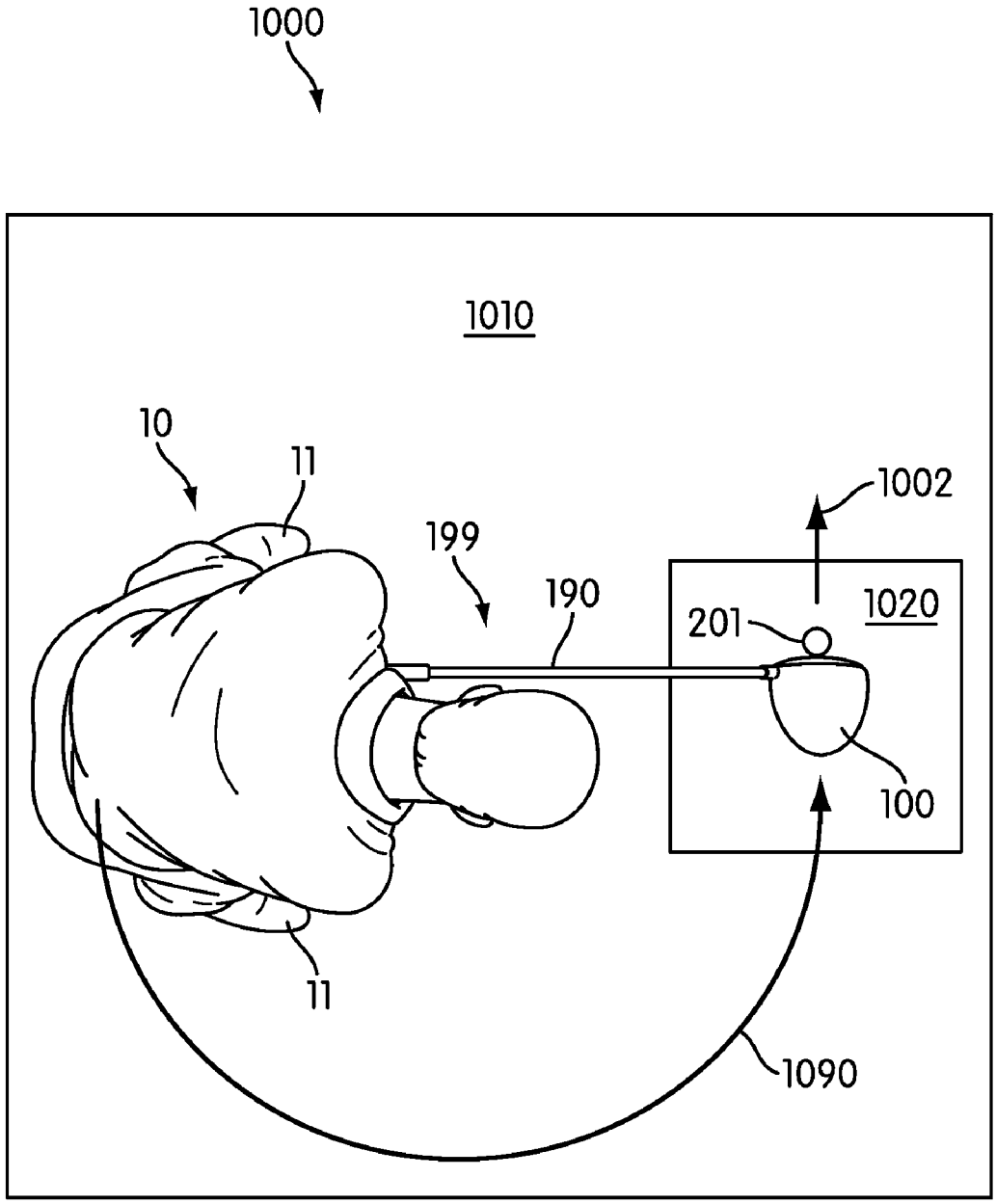
FIGS. 10A-C are illustrative diagrams depicting various aspects of a method of fitting a golf club head.
Figure 10B:
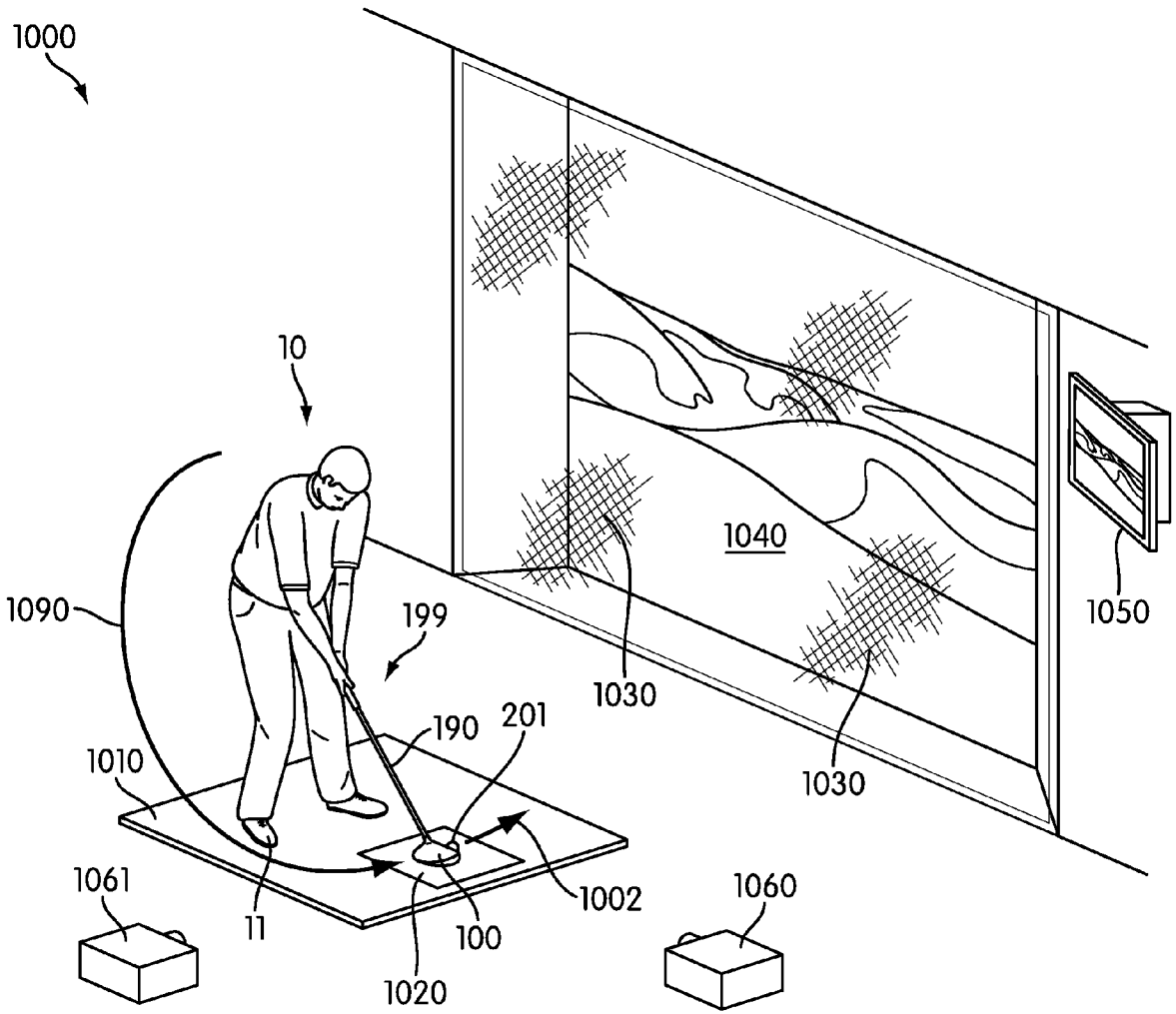
Figure 10C:
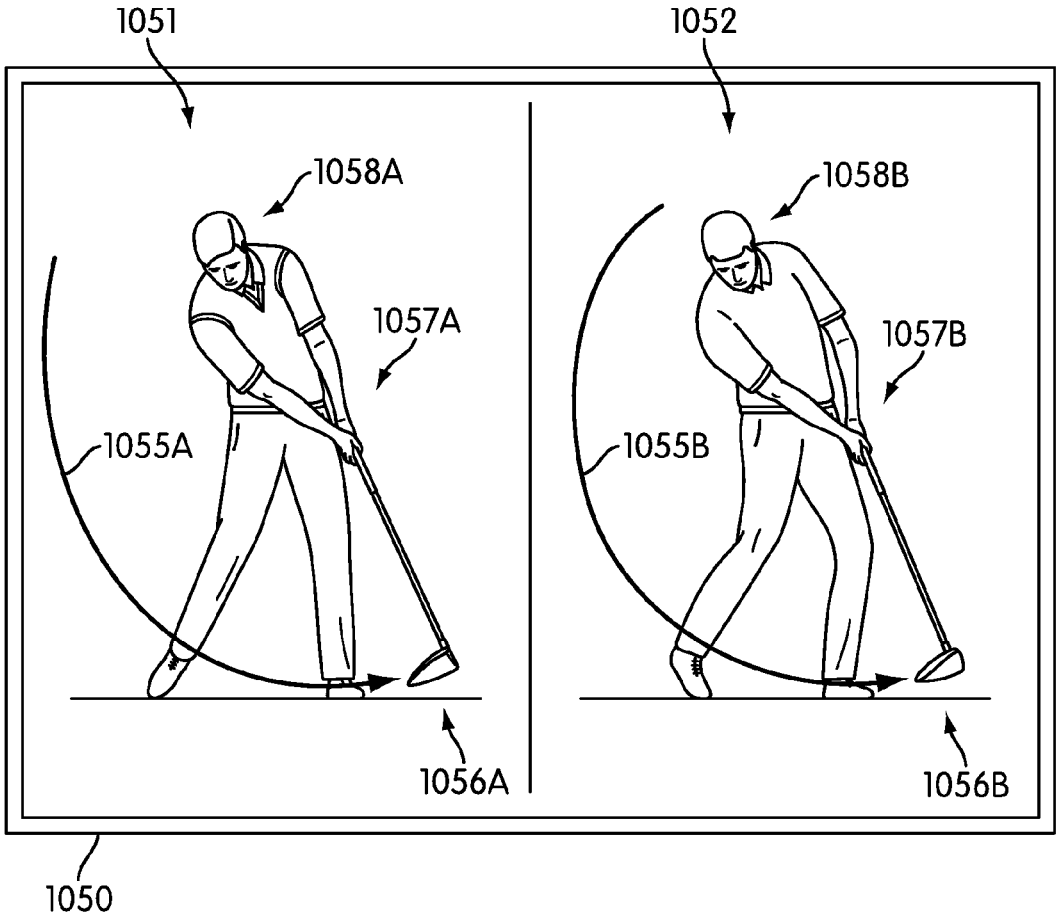

As alluded to earlier, FIGS. 10A-10C illustratively depict one manner of fitting a golf club 199 including a golf club head 100. As is known, a golfer 10 may perform a number of swings in front of one or more golf professionals or golf club fitters. The movements including the golf swing may be viewed, recorded, and/or measured by a measuring device including a videographic device like a digital video camera. FIGS. 10A and 10B illustrate top plan and rear views respectively of a golfer swinging a golf club and hitting golf balls in an illustrative fitting station 1000. The fitting station 1000 may have any of a number of arrangements and features. The fitting station 1000 shown in FIGS. 10A-10C is an indoor fitting station. However, fitting stations 1000 may be indoor or outdoor and may be located at a driving range or other practice facilities, at a golf course including in or near a pro shop and various other locations as are known. The fitting station 1000 may include a hitting mat 1010, especially when the fitting station is an indoor station or when the station is part of a driving range. However, a fitting station may be located on a grass tee box or other outdoor natural golf environment. Here, the indoor fitting station 1000 also includes a net 1030 that a golfer 10 may hit the ball into in performing his or her shots, practice swings and swings in front of a golf professional or golf club fitter. The net 1030 permits the fitting to be done in a more limited space such as indoors, in a pro shop or in a driving range with limited land available. Behind the net 1030 may be a background 1040 or other structures that may make the golfer feel as if he is on the golf course. Also, while not specifically depicted, the background may house or protect a further measuring device(s) including velocity or force sensors, videographic devices and other devices that may be utilized in the fitting of the golfer.

The ball travel of a golfer's shot may be monitored by watching an entire ball flight at a fitting station on a driving range that possesses sufficient space for the ball to travel until it comes to a natural stopping point/lie. Also, a golfer may also hit in a confined spaced monitored by a digital video camera or other measuring devices that can determine the travel path based upon initial characteristics of the shot including velocity, trajectory, spin etc. Further measuring devices may be used to further understand the swing path and related tendencies of a golfer. In one example configuration, a golfer's swing may be filmed using a digital video camera device 1060. In particular the golfer's swing may be filmed from a toe end view such that the golfer has a stance square to and facing the camera. In another configuration, the golfer's swing my alternatively or additionally be filmed by a measuring device positioned at a position such as the position where measuring device 1061 is illustratively shown as being. By filming the golfer's swing from square orientations such as the rear and toe end, the video may be compared to images and swing paths performed and recorded by a golfer having preferred mechanics as is shown in FIG. 10C.

Among the devices and tests that may be used to monitor the swing path, contact orientation and related characteristics of a golfer swing are video recording, radar tracking including Doppler radar technology, motion detection devices, speed radar devices, ball flight tracking devices and monitoring systems and similar golf swing analysis devices as are known in the art. These measuring devices may be positioned as illustrative measuring devices 1060, 1061 are shown as being positioned. These devices may also be positioned in front of the golfer 10 such that the golfer is hitting at the measuring device or on the heel end side of the golfer behind the golfer's back. Even further, measuring devices may be placed overhead or practically anywhere such that the measuring devices can record data such as video images of the golfer's movements or track and record data or characteristics associated with the portions of the golf club or ball movement such as velocity, direction, orientation, and other characteristics as are known. Other devices focused at determining the golf club's orientation during the swing and in particular the orientation of the golf club through the hitting zone when the golf club head strikes the golf ball may be utilized. These devices may be the same or similar devices as the videographic, radar or other motion tracking devices or the devices may be as simple as lie board devices 1020 which depict where a bottom surface of the golf club contacts the ground and the direction of movement and orientation of the club through the hitting zone. Also basic tape devices placed over the hitting surface 125 of a golf club head may be used to provide data regarding the portion of the hitting surface 125 where the golf ball is being hit to determine whether the ball is being hit in a sweet spot or off-center such that the swing or club may need adjustment to optimize results.

After a sufficient number of swings and "practice" or "sample" shots have been made to provide a desired sampling of shots to provide for a reliable fitting, the golf and/or fitting professionals can use the data collected to recommend a particular golf club head 100 housing a visual swing indicator 400 that will help the golfer performing a golf swing more regularly according to traditional preferred swing mechanics. Among the characteristics collected or measured may include swing path data, trajectory, orientation of the golf club on impact, ball spin, ball flight and physical dimensions and ergonomic characteristics of the golfer, to name just a few. The analysis of the swings including swing patterns can be used to determine a desired swing path, tendencies of the golfer's swing, and changes to the golfer's current swing path such that the specific changes required may be more visibly noticeable.

FIG. 10C illustrates a display 1050 depicting two respective swing characteristics outputs 1051, 1052 illustratively depicting two swings of golfers in videographic form such as a digital video. In one arrangement the displayed swing 1051 may be a videographic image of preferred swing of a professional golfer or other golfer including a "virtual golfer" with preferred swing mechanics. On the right, the golf swing 1052 may be an actual swing of a golfer 10 currently being analyzed in the fitting station 1000. Through the split screen comparison on display 1050, a golfer may be analyzed and fitted for a particular golf club features such as visual swing indicators, shaft characteristics, and alignment aides and other features to facilitate a golfer swinging in a preferred manner to achieve preferred performance. For example, backswing paths 1055A, 1055B of the golfers may be compared during the swings 1051, 1052. Likewise, the orientations of the golf club head 1056A, 1056B, the golfers' arm and hand positions 1057A, 1057B, and the head positions 1058A, 1058B may be compared visual. Other comparisons and analysis may be performed as is known. While the display 1050 here illustrates videographic information relating to the golfers' swings, the display 1050 may be utilized during other aspects of the analysis including output of various other characteristics utilized in fitting the golfer 10. Further, as shown in FIG. 10B the display 1050 may also be used to enhance the fitting experience and may be visible to the golfer during the fitting process. However, various configurations of outputs can be used to perform a swing analysis and provide output data relating to the golfer's swing to the golfer or the golf professional.

The present invention is disclosed above and in the accompanying drawings with reference to a variety of embodiments. The purpose served by disclosure of the embodiments, however, is to provide an example of the various aspects embodied in the invention, not to limit the scope of the invention. One skilled in the art will recognize that numerous variations and modifications may be made to the embodiments without departing from the scope of the present invention, as defined by the appended claims.

The invention claimed is:

1. A golf club head comprising:

a body including a hitting surface configured for striking a golf ball; and an asymmetrical visual swing indicator on a topsurface of the body, the asymmetrical visual swing indicator configured to represent an apparent backswing path, the apparent backswing path being distinct and outward of an actual backswing path;

wherein the widest portion of the asymmetrical visual swing indicator is positioned on a heel end half of the golf club head and is a portion of the asymmetrical visual swing indicator closest to the hitting surface and wherein the narrowest portion of the asymmetrical visual swing indicator is positioned on a toe end half of the golf club head and is a portion of the asymmetrical visual indicator closest to a rear surface of the golf club head opposite the hitting surface.

2. The golf club head of claim 1, wherein the asymmetrical visual swing indicator is integrally and non-removably formed in the top surface of the body.

3. The golf club head of claim 1, wherein the asymmetrical visual swing indicator continuously narrows from the widest portion to the narrowest portion.

4. The golf club head of claim 3, wherein a shortest side of the asymmetrical visual swing indicator is co-linear to a portion of the hitting surface immediately adjacent to the shortest side of the asymmetrical visual swing indicator.

5. The golf club head of claim 4, wherein the asymmetrical visual swing indicator is triangularly shaped, each of the sides of the triangularly shaped asymmetrical visual swing indicator having a different length.

6. The golf club head of claim 1, wherein the golf club head is a wood-type golf club head.

7. The golf club head of claim 1 further comprising an attachment means for removably securing the asymmetrical visual swing indicator to the top surface of the body.

8. The golf club head of claim 7, wherein the attachment means is configured to secure any of a plurality of distinct asymmetrical visual swing indicators to the top surface of the body and to permit removal and replacement of the asymmetrical visual swing indicator with another of the plurality of distinct asymmetrical visual swing indicators.

9. A golf club comprising the golf club head of claim 1 and a shaft coupled to the golf club head.

10. The golf club head of claim 1, wherein the portion of the asymmetrical visual swing indicator closest to a rear surface forms a point.

11. The golf club head of claim 1, wherein the asymmetrical visual swing indicator comprises one of a coating, a film, an adhesive tape and an appliqué housed on the top surface of the body.

12. The golf club head of claim 1, wherein a portion of the top surface of the golf club head is a recess and the asymmetrical visual swing indicator is housed in the recess.

13. The golf club head of claim 1, wherein a portion of the top surface of the golf club head is a recess and the asymmetrical visual swing indicator is housed in the recess.

14. A golf club head comprising:

a body including a hitting surface configured for striking a golf ball; and an asymmetrical visual swing indicator on a top surface of the body, the asymmetrical visual swing indicator configured to represent an apparent backswing path, the apparent backswing path being distinct and outward of an actual backswing path;

wherein the widest portion of the asymmetrical visual swing indicator is a portion of the asymmetrical visual swing indicator closest to the hitting surface and the narrowest portion of the asymmetrical visual swing indicator is a portion of the asymmetrical visual indicator closest to a rear surface of the golf club head opposite the hitting surface;

wherein the asymmetrical visual swing indicator continuously narrows from the widest portion to the narrowest portion;

wherein the shortest side of the asymmetrical visual swing indicator is co-linear to a portion of the hitting surface immediately adjacent to the shortest side of the asymmetrical visual swing indicator;

wherein the asymmetrical visual swing indicator is triangularly shaped, each of the sides of the triangularly shaped asymmetrical visual swing indicator having a different length;

wherein the longest two sides of the triangularly shaped asymmetrical visual swing indicator are positioned to extend from opposing ends of the shortest side of the asymmetrical visual swing indicator on a heel end of the top surface of the body connecting and ending in a pointed end at a toe end of the top surface of the body.

15. The golf club head of claim 14, wherein the golf club head is a wood-type golf club head.

16. The golf club head of claim 14 further comprising an attachment means for removably securing the asymmetrical visual swing indicator to the top surface of the body.

17. The golf club head of claim 16, wherein the attachment means is configured to secure any of a plurality of distinct asymmetrical visual swing indicators to the top surface of the body and to permit removal and replacement of the asymmetrical visual swing indicator with another of the plurality of distinct asymmetrical visual swing indicators.

18. A golf club comprising the golf club head of claim 14 and a shaft coupled to the golf club head.

19. The golf club head of claim 14, wherein the portion of the asymmetrical visual swing indicator closest to a rear surface forms a point.

20. The golf club head of claim 14, wherein the asymmetrical visual swing indicator comprises one of a coating, a film, an adhesive tape and an appliqué housed on the top surface of the body.

21. The golf club head of claim 14, wherein a portion of the top surface of the golf club head is a recess and the asymmetrical visual swing indicator is housed in the recess.

22. The golf club head of claim 14, wherein the asymmetrical visual swing indicator is integrally and non-removably formed in the top surface of the body.

* * * * *